US009452461B2

(12) United States Patent
Yamagata et al.

(10) Patent No.: US 9,452,461 B2
(45) Date of Patent: Sep. 27, 2016

(54) PRESS FORMING METHOD

(71) Applicant: NIPPON STEEL & SUMITOMO METAL CORPORATION, Tokyo (JP)

(72) Inventors: Mitsuharu Yamagata, Tokyo (JP); Shuji Yamamoto, Tokyo (JP); Yasuhiro Wada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/653,192

(22) PCT Filed: Dec. 26, 2013

(86) PCT No.: PCT/JP2013/084881
§ 371 (c)(1),
(2) Date: Jun. 17, 2015

(87) PCT Pub. No.: WO2014/109245
PCT Pub. Date: Jul. 17, 2014

(65) Prior Publication Data

US 2015/0367398 A1 Dec. 24, 2015

(30) Foreign Application Priority Data

Jan. 9, 2013 (JP) ..... 2013-001832

(51) Int. Cl.
*B21D 22/21* (2006.01)
*B21D 24/00* (2006.01)
(Continued)

(52) U.S. Cl.
CPC ..... *B21D 24/005* (2013.01); *B21D 22/21* (2013.01); *B21D 22/30* (2013.01); *B21K 23/00* (2013.01); *B21K 23/02* (2013.01)

(58) Field of Classification Search
CPC ..... B21D 22/20; B21D 22/21; B21D 22/22; B21D 21/24; B21D 22/28; B21D 22/30; B21D 24/005
See application file for complete search history.

(56) References Cited

U.S. PATENT DOCUMENTS 5,722,282 A 3/1998 Mine et al.
2011/0165431 A1* 7/2011 Inoue ..... B21D 22/02 428/599
2012/0282482 A1* 11/2012 Flehmig ..... B21D 22/22 428/603

FOREIGN PATENT DOCUMENTS

JP 61-269938 A 11/1986
JP 8-141662 A 6/1996
(Continued)

OTHER PUBLICATIONS

International Preliminary Report on Patentability dated Jul. 23, 2015, issued in PCT/JP2013/084881 (Forms PCT/IB/338, PCT/IB/373 and PCT/ISA/237).
(Continued)

*Primary Examiner* — Debra Sullivan
(74) *Attorney, Agent, or Firm* — Birch, Stewart, Kolasch & Birch, LLP

(57) ABSTRACT

A press forming apparatus (1*a*) consecutively carries out: a first step of pushing a flat plate-shaped workpiece into a die (14) by a forming punch (11), to form the workpiece into a cup-shaped workpiece (B); a second step of making the cup-shaped workpiece (B) move relatively to a position where a space (S2) is formed between a cup bottom part (B2) and the forming punch (11) by a holding down member (12) abutting on an end part of a cup vertical wall part (B1); and a third step of making a counter punch (13) approach the forming punch (11), to push a cup bottom part (B2) to a forming punch (11) side so that the cup bottom part (B2) is compressed by the forming punch (11) and the counter punch (13), making a material of the cup vertical wall part (B1) flow to a cup shoulder part (B3), thereby to thicken the cup shoulder part (B3).

5 Claims, 9 Drawing Sheets

(51) Int. Cl.

| | |
|---|---|
| ***B21D 22/30*** | (2006.01) |
| ***B21K 23/00*** | (2006.01) |
| ***B21K 23/02*** | (2006.01) |

(56) References Cited

FOREIGN PATENT DOCUMENTS

| | | | |
|---|---|---|---|
| JP | 10-296346 | A | 11/1998 |
| JP | 10-329203 | A | 12/1998 |
| JP | 2001-47175 | A | 2/2001 |
| JP | 2001-314921 | A | 11/2001 |
| JP | 2007-289989 | A | 11/2007 |

OTHER PUBLICATIONS

International Search Report, mailed Apr. 8, 2014, issued in PCT/JP2013/084881.

Written Opinion of the International Searching Authority, mailed Apr. 8, 2014, issued in PCT/JP2013/084881.

* cited by examiner

PRESS FORMING METHOD

TECHNICAL FIELD

The present invention relates to a press forming method to form a flat plate-shaped workpiece into a cup shape.

BACKGROUND ART

A cup-shaped axially symmetrical component having a cup vertical wall part and a cup bottom wall part is known as a component used for a transmission or the like of a vehicle. If common drawing is used to obtain a cup-shaped axially symmetrical component, a cup shoulder part abutting on a shoulder R part of a drawing punch is thinned. As literatures to disclose a technique to improve or to avoid the above, Patent Literatures 1, 2 below are known.

In Patent Literature 1, first, drawing is carried out by an apparatus for drawing, to form a workpiece into a cup shape. Next, in Patent Literature 1, a cup bottom part of the cup-shaped workpiece is subjected to coining by an apparatus for coining, to supply a material from a cup bottom part to a cup shoulder part having been thinned due to drawing, so that the cup shoulder part is thickened.

In Patent Literature 2, a punch is inserted into a cup-shaped workpiece and an inner wall surface of a cup vertical wall part is restrained by the punch. Subsequently, in Patent Literature 2, an outer wall surface of the cup vertical wall part is subjected to ironing from a cup opening part side toward a cup bottom part side by a roller, so that a cup shoulder part is thickened.

CITATION LIST

Patent Literature

Patent Literature 1: Japanese Laid-open Patent Publication No. 8-141662

Patent Literature 2: Japanese Laid-open Patent Publication No. 2007-289989

SUMMARY OF INVENTION

Technical Problem

However, in Patent Literature 1, since the cup bottom part is subjected to coining when the cup shoulder part is thickened, there is a problem that the cup bottom part becomes not planar due to thickness reduction of a part of the cup bottom part. In Patent Literature 2, since the cup shoulder part is thickened by ironing of the cup vertical wall part, there is a problem that the cup vertical wall part is thinned.

An object of the present invention is to provide a press forming method to contrive suppression of thinning of a cup shoulder part, suppression of thinning of a cup vertical wall part, and planarization of a cup bottom part simultaneously at a time of forming a flat plate-shaped workpiece into a cup shape.

Solution to Problem (1) In order to solve the above-described problems, a press forming method according to the present invention is a press forming method carrying out press forming to a flat plate-shaped workpiece by using a press forming die which has a forming punch, a holding down member disposed along an outer periphery of the forming punch, a counter punch disposed to face the forming punch in a center axis direction, and a die in whose insertion hole part the counter punch is disposed and one end side inner wall surface of whose insertion hole part into which the forming punch is inserted is a die shoulder part, center axes thereof being coaxially disposed to one another, the press forming method sequentially carries out: a first step of pushing the flat plate-shaped workpiece into the insertion hole part via the die shoulder part by making the forming punch move relatively in relation to the die and be inserted into the insertion hole part, thereby to form the workpiece into a cup-shaped workpiece having a cup vertical wall part, a cup bottom part, and a cup shoulder part connecting the cup vertical wall part and the cup bottom part; a second step of making the cup-shaped workpiece move relatively in relation to the forming punch, to a position where a space is formed between the cup bottom part and the forming punch by the holding down member abutting on a cup opening part side end part of the cup vertical wall part; and a third step of restraining deformation in a plate thickness direction of the cup vertical wall part by the forming punch and the die and making the counter punch approach the forming punch in a state where a relative position in relation to the forming punch of the cup vertical wall part is fixed by the holding down member, to push the cup bottom part to a forming punch side, to make the cup bottom part compressed by the forming punch and the counter punch, and to make a material of the cup vertical wall part flow to the cup shoulder part, thereby to thicken the cup shoulder part.

(2) In the press forming method according to the above-described (1), the holding down member may be a cylindrical blank holder punch whose inner peripheral surface in a radial direction orthogonal to the center axis runs along an outer peripheral surface of the forming punch and whose outer peripheral surface in the radial direction runs along an inner peripheral surface of the insertion hole part of the die, and in the third step the cup bottom part may be compressed by the forming punch and the counter punch in a state where a relative position in relation to the forming punch of the cup vertical wall part is fixed by the holding down member inserted between the forming punch and the die and deformation in the plate thickness direction on a cup opening part side in the cup vertical wall part is restrained by the forming punch and the die.

By such a configuration, since the blank holder punch which can be moved relatively between the forming punch and the die is used as the holding down member, the cup bottom part can be compressed in a state where the cup opening part side end part of the cup-shaped workpiece on a distant side of the insertion hole part is held down by the blank holder punch, that is, in a state where deformation in the thickness direction of the cup opening part side in the cup vertical wall part is restrained by the forming punch and the die. Thus, it is possible to make a material flow to the cup shoulder part securely by compression of the cup bottom part.

(3) In the press forming method according to the above-described (1), in the first step, the forming punch may be moved in a first direction along the center axis and the forming punch may be inserted into the die, thereby to form the workpiece into the cup-shaped workpiece, and in the second step, the forming punch may be made to recede in a second direction opposite to the first direction and the counter punch may be moved in the second direction to make the cup vertical wall part abut on the holding down member placed further in the second direction than the die, thereby to make the cup-shaped workpiece move relatively to a position where the space is formed between the cup bottom part and the forming punch.

When a cup-shaped workpiece is to be made to move relatively to a position where a space is formed between a cup bottom part and a forming punch by relative movement of a holding down member between the forming punch and a die after forming of the cup-shaped workpiece, it is necessary to prepare a holding down member in correspondence with a thickness (a space between the forming punch and the die) of the cup-shaped workpiece being a forming object. Compared with such a configuration, according to a configuration of (3), insertion of the holding down member between the forming punch and the die is not necessary for the purpose of moving the cup-shaped workpiece relatively to the position where the space is formed between the cup bottom part and the forming punch. Thus, according to the configuration of (3), forming can be carried out by using the same holding down member regardless of a thickness of a cup-shaped workpiece being a forming object, so that versatility can be improved.

(4) In the press forming method according to the above-described (3), an outer diameter of the holding down member may be larger than an outer diameter of the die shoulder part. By such a configuration, it is possible to carry out forming in a state where a surface facing the die of the holding down member is made to abut on the die, and action control of the form can be carried out easily.

(5) In the press forming method according to the above-described (3) or (4), in the third step, the counter punch may be moved in the second direction from a state where a portion in which deformation in the plate thickness direction is not restrained exists, the portion being a portion positioned between the die shoulder part and the forming punch in the cup vertical wall part, and from a state where the space exists between the cup bottom part and the forming punch, and a weighted load of the counter punch may be monitored, and when the weighted load reaches a predetermined value, movement of the counter punch in the second direction may be halted, thereby to suppress flowing of a material to the portion positioned between the die shoulder part and the forming punch in the cup vertical wall part.

Advantageous Effects of Invention

According to the present invention, it is possible to provide a press forming method to contrive suppression of thinning of a cup shoulder part, suppression of thinning of a cup vertical wall part, and planarization of a cup bottom part simultaneously at a time that a plate-shaped workpiece is formed into a cup shape.

DESCRIPTION OF EMBODIMENTS

Hereinafter, each embodiment of the present invention will be described with reference to the drawings.

First Embodiment

Figure 1:
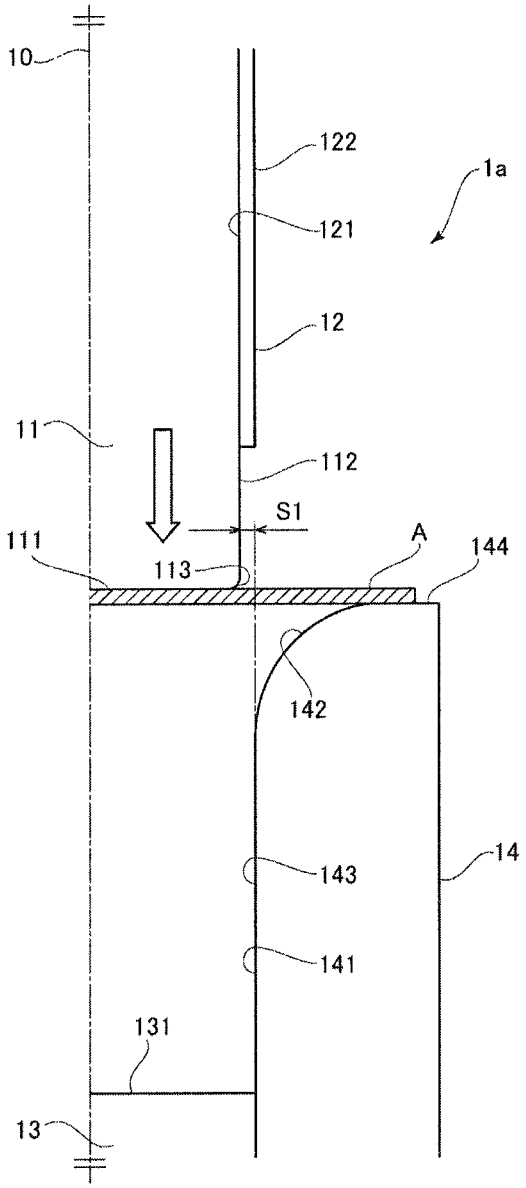
FIG. 1 is a schematic configuration diagram of a press forming apparatus of a first embodiment.

FIG. 1 is a schematic configuration diagram of a press forming apparatus of a first embodiment. A side cross section of a press forming apparatus 1*a* is axially symmetrical, and FIG. 1 and FIG. 2 to FIG. 9 shown later each show one side part from a center axis 10 of the press forming apparatus 1*a* or 1*b*.

The press forming apparatus 1*a* first forms a disk-shaped (flat plate-shaped) workpiece A into a cup shape. A member formed into the cup shape is referred to as a cup-shaped workpiece B. Next, there is carried out press forming to thicken a cup shoulder part B3 of the cup-shaped workpiece B which has been thinned at a time of forming into the cup shape. The press forming apparatus 1*a* carries out the press forming by using a press forming die which has a forming punch 11, a blank holder punch 12 (holding down member), a counter punch 13, and a die 14. The press forming apparatus 1*a* consecutively carries out a step of forming the cup-shaped workpiece B from the disk-shaped workpiece A and press forming to thicken the cup shoulder part B3 of the cup-shaped workpiece B which has been formed, without detaching the cup-shaped workpiece B from the press forming apparatus 1*a*. These forming punch 11, blank holder punch 12, counter punch 13, and die 14 are disposed axially symmetrically (in other words, coaxially) in relation to the center axis 10, and each can be moved upward and downward independently. Note that it is possible that the die 14 is fixed, with the forming punch 11, the blank holder punch 12, and the counter punch 13 being moved relatively in relation to the die 14, for example. Even with the above configuration, press forming similar to that in a case of moving the forming punch 11, the blank holder punch 12, the counter punch 13, and the die 14 upward and downward independently is possible.

The forming punch 11 is column-shaped, and a tip surface 111 facing the counter punch 13 is a plane parallel to an orthogonal direction of the center axis 10. A tip corner portion of the forming punch 11 is an R-shaped punch shoulder part 113. The punch shoulder part 113 connects a peripheral portion of the tip surface 111 and a lower end portion in an outer peripheral surface 112 of the forming punch 11.

The blank holder punch 12 is cylindrical, and is disposed along the outer peripheral surface 112 of the forming punch 11. In the blank holder punch 12, an inner peripheral surface 121 in a radial direction orthogonal to the center axis 10 runs along the outer peripheral surface 112 of the forming punch 11, while an outer peripheral surface 122 in the radial direction runs along an inner peripheral surface 143 of a later-described insertion hole part 141 of the die 14. A thickness of a thick portion of the blank holder punch 12 is a thickness allowing insertion into between the die 14 and the forming punch 11 which is inserted into the die 14 at a time of forming of the disk-shaped workpiece A.

The counter punch 13 is column-shaped, and is disposed in a manner that its tip surface 131 faces the tip surface 111 of the forming punch 11 in a center axis 10 direction. In the counter punch 13, the tip surface 131 facing the tip surface 111 of the forming punch 11 is a plane parallel to the orthogonal direction of the center axis 10.

An upper end surface 144 of the die 14 is positioned lower than the tip surface 111 of the forming punch 11 at a start time of forming of the disk-shaped workpiece A. The die 14 is circular ring-shaped, and has the insertion hole part 141 extending in an axial direction. The counter punch 13 is disposed inside the insertion hole part 141. The forming punch 11 and the blank holder punch 12 are inserted into the insertion hole part 141 at the time of forming of the disk-shaped workpiece A. An R-shaped die shoulder part 142 which is widened as going upward is formed in one end side inner wall surface (tip side inner wall surface) of the insertion hole part 141 into which the forming punch 11 is inserted at the time of forming.

The die shoulder part 142 connects the inner peripheral surface 143 of the insertion hole part 141 and the upper end surface 144. The upper end surface 144 is circular ring-shaped in center axis 10 direction view, and is a plane parallel to the orthogonal direction of the center axis 10. An inside diameter of the upper end surface 144 is smaller than an outside diameter of the disk-shaped workpiece A. Thereby, the upper end surface 144 functions as a supporting surface which supports an outer edge portion of the disk-shaped workpiece A at the start time of forming of the disk-shaped workpiece A. A distance S1 between the outer peripheral surface 112 of the forming punch 11 and the inner peripheral surface 143 of the die 14 in the radial direction is a size similar (including an error) to a thickness of the disk-shaped workpiece A.

Figure 2:
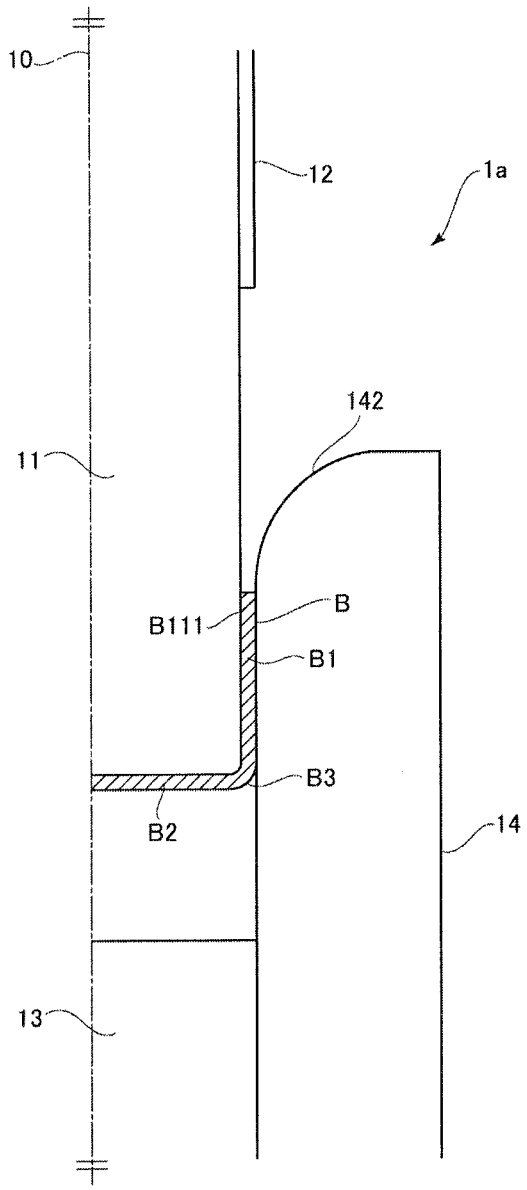
FIG. 2 is a diagram showing an example of a forming situation of the press forming apparatus.

Hereinafter, a forming action (press forming method) of the press forming apparatus 1*a* will be described. As shown in FIG. 1, the disk-shaped workpiece A is set on the upper end surface 144 of the die 14. The press forming apparatus 1*a* moves the forming punch 11 downward so that the forming punch 11 is inserted into the insertion hole part 141, whereby the disk-shaped workpiece A is pushed into the insertion hole part 141 via the die shoulder part 142. Thereby, as shown in FIG. 2, the press forming apparatus 1*a* forms the disk-shaped workpiece A into the cup-shaped workpiece B with a bottomed cylinder shape which has a cup vertical wall part B1, a cup bottom part B2, and a cup shoulder part B3 connecting the cup vertical wall part B1 and the cup bottom part B2 (first step). Further, a cup opening part B111 is formed in the cup-shaped workpiece B. On this occasion, the cup shoulder part B3 is thinned compared with a thickness of the disk-shaped workpiece A. Incidentally, the blank holder punch 12 is not moved downward but maintains an initial position apart from the cup-shaped workpiece B.

Figure 3:
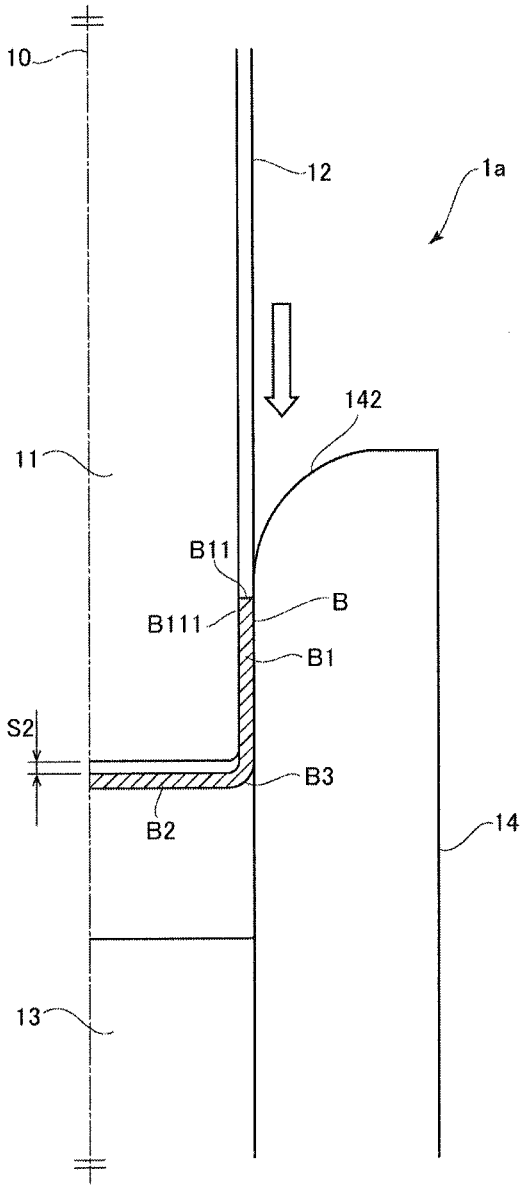
FIG. 3 is a diagram showing an example of the forming situation of the press forming apparatus.

Next, as shown in FIG. 3, the press forming apparatus 1*a* moves the blank holder punch 12 downward while maintaining a position of the forming punch 11 at a position (position shown in FIG. 2) in the first step. Then, the press forming apparatus 1*a* makes the blank holder punch 12 abut on an end part B11 (hereinafter, described as a cup opening part side end part B11) on a cup opening part B111 side of the cup vertical wall part B1, and further pushes the cup-shaped workpiece B to down below the forming punch 11 by the blank holder punch 12. Thereby, the press forming apparatus 1*a* makes the cup-shaped workpiece B move to a position where a space S2 of a predetermined size is formed between the cup bottom part B2 and the forming punch 11 (second step).

Figure 4:
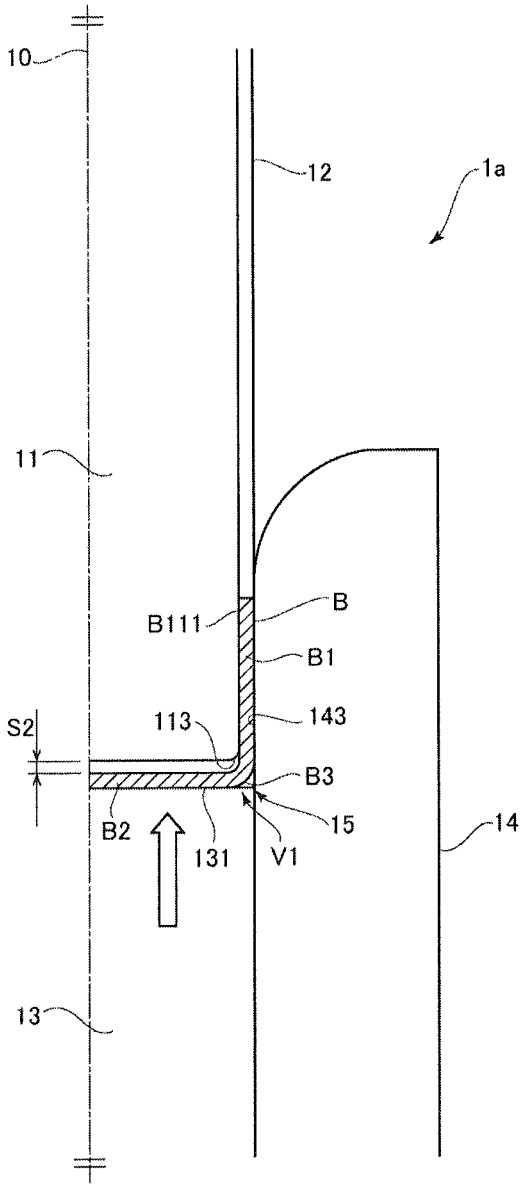
FIG. 4 is a diagram showing an example of the forming situation of the press forming apparatus.

On this occasion, the press forming apparatus 1*a* comes into a state where deformation in a plate thickness direction of the cup vertical wall part B1 is restrained by the forming punch 11 and the die 14 and upward movement of the cup vertical wall part B1 is held down by the blank holder punch 12 (a state where a relative position in relation to the forming punch 11 of the cup vertical wall part B1 is fixed by the blank holder punch 12). In this state, as shown in FIG. 4, the press forming apparatus 1*a* moves the counter punch 13 upward to make the counter punch 13 approach the forming punch 11. Thereby, the press forming apparatus 1*a* pushes the cup bottom part B2 to a forming punch 11 side, to compress the cup bottom part B2 by the forming punch 11 and the counter punch (third step).

Figure 5:
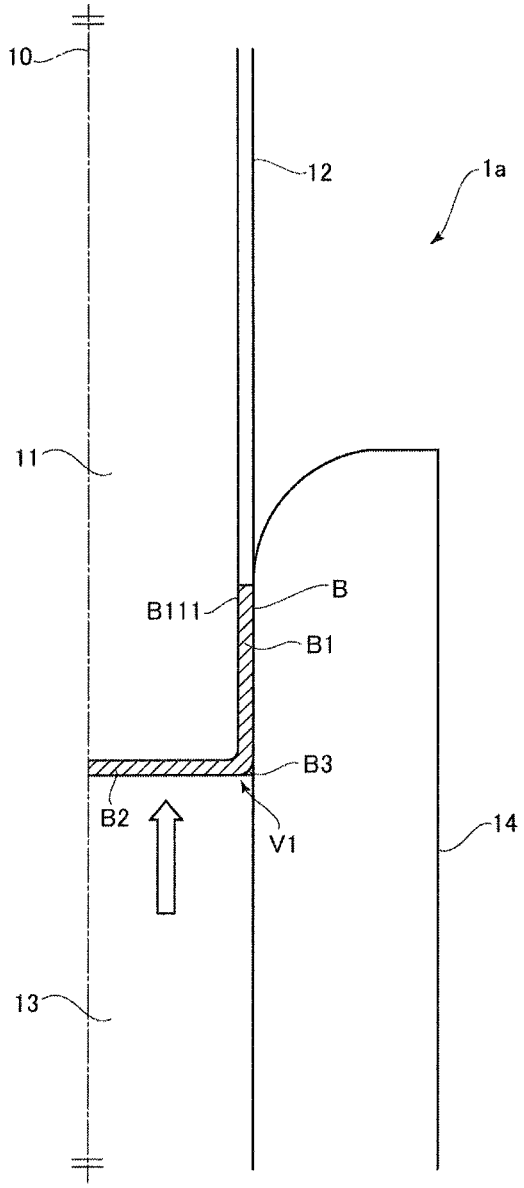
FIG. 5 is a diagram showing an example of a forming completion situation of the press forming apparatus.

On this occasion, a peripheral void V1 is formed between a corner part 15 formed by the inner peripheral surface 143 of the die 14 and the tip surface 131 of the counter punch 13, and the punch shoulder part 113 of the forming punch 11. This peripheral void V1 is larger than a size of the cup shoulder part B3 before forming. Therefore, as shown in FIG. 5, the press forming apparatus 1*a* makes a material in a neighboring portion of the cup shoulder part B3 flow into the void V1 speedily (prompts material flow) by pushing the cup bottom part B2 to the forming punch 11 side in a state where upward movement of the cup vertical wall part B1 is limited by the blank holder punch 12. Thereby, the cup shoulder part B3 is thickened easily. On the other hand, in the cup vertical wall part B1, a portion on a cup opening part B111 side in which material flow does not occur maintains a plate thickness. As described above, in the present embodiment, since the cup vertical wall part B1 is not ironed, it is possible to thicken the cup shoulder part B3 while preventing thinning of the cup vertical wall part B1.

Figure 6:
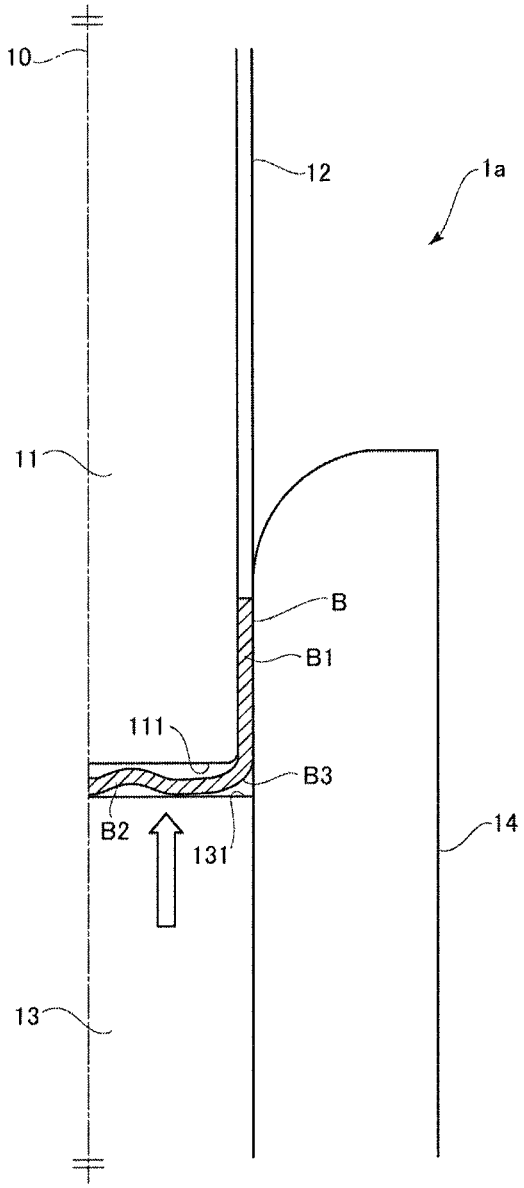
FIG. 6 is a diagram showing wrinkling of a cup bottom part which occurs at a time of forming into a cup shape.

Further, when the disk-shaped workpiece A is formed into the cup-shaped workpiece B in the first step, as shown in FIG. 6, there is a case where projection/recession such as wrinkling occurs in the cup bottom part B2, to bring about loss of planeness of the cup bottom part B2 in a range not hampering practical use of the cup-shaped workpiece B. In the present embodiment, since the cup bottom part B2 is compressed by the planar tip surface 111 of the forming punch 11 and the planar tip surface 131 of the counter punch 13, the cup bottom part B2 can be made planar even in the above case, and the cup-shaped workpiece B can be shape-corrected.

In the present embodiment, first, the disk-shaped workpiece A is pushed into the die 14 by the forming punch 11, whereby the disk-shaped workpiece A is formed into the cup-shaped workpiece B. Thereafter, the blank holder punch 12 is inserted between the forming punch 11 and the die 14 to push the cup-shaped workpiece B out of the forming punch 11, whereby the cup-shaped workpiece B is made to move to a position where the space S2 is formed between the cup-shaped workpiece B and the forming punch 11. Therefore, in the present embodiment, the consecutive two actions described above can make the cup-shaped workpiece B move to the position where the space S2 is formed between the cup-shaped workpiece B and the forming punch 11, so that man-hour can be curtailed.

In the present embodiment, since the blank holder punch 12 with a small thickness is used as a holding down member, the blank holder punch 12 can be inserted between the forming punch 11 and the die 14. Therefore, the cup bottom part B2 can be compressed in a state where the blank holder punch 12 holds down the cup opening part side end part B11 of the cup-shaped workpiece B on a distant side of the insertion hole part 141, that is, in a state where the forming punch 11 and the die 14 restrain deformation in the thickness direction of the cup opening part B111 side of the cup vertical wall part B1 of the cup-shaped workpiece B in the distant side of the insertion hole part 141. Thus, it is possible to make the material flow to the cup shoulder part B3 securely by compression of the cup bottom part B2. Further, since the cup vertical wall part B1 is maintained to be in a state of being sandwiched between the forming punch 11 and the die 14, deformation, for example, buckling or the like, does not occur in a portion on the cup opening part B111 side in the cup vertical wall part B1.

Second Embodiment

Figure 7:
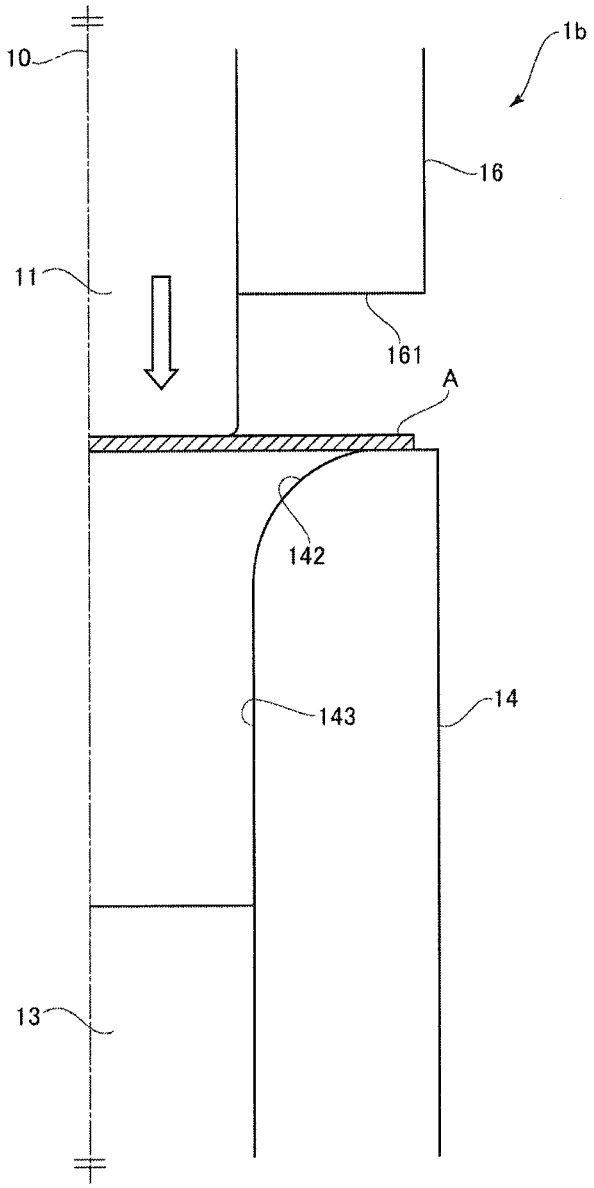
FIG. 7 is a schematic configuration diagram of a press forming apparatus of a second embodiment.

FIG. 7 is a schematic configuration diagram of a press forming apparatus 1*b* of a second embodiment. Note that a configuration common to that of the first embodiment is granted the same reference symbol.

In the present embodiment, a base 16 is used as a holding down member to hold down a cup vertical wall part B1. The base 16 is cylindrical and is disposed along an outer periphery of a forming punch 11. A lower end surface of the base 16 is a ring-shaped holding down surface 161. The ring-shaped holding down surface 161 is larger than a die shoulder part 142 in outer diameter and faces a die 14 in a center axis 10 direction. In other words, the base 16 cannot enter between the forming punch 11 and the die 14.

Figure 8:
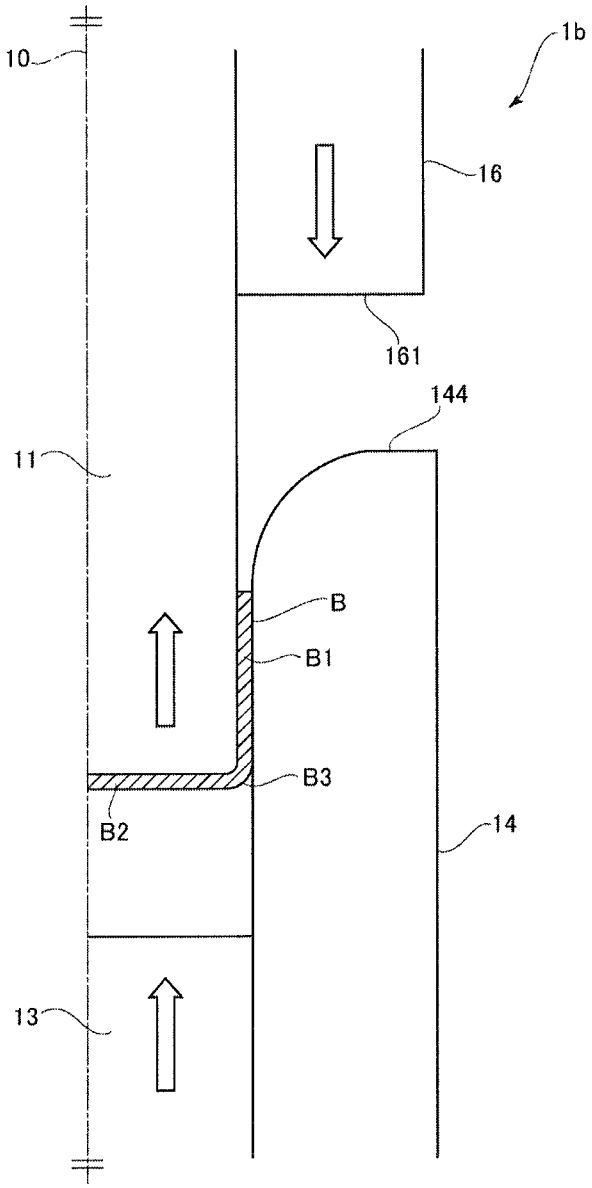
FIG. 8 is a diagram showing an example of a forming situation of the press forming apparatus.

Hereinafter, a forming action of the press forming apparatus 1*b* of the present embodiment will be described simply. As shown in FIG. 8, the press forming apparatus 1*b* pushes a disk-shaped workpiece A into an insertion hole part 141 of the die 14 by the forming punch 11, so that the disk-shaped workpiece A is formed into a cup-shaped workpiece B (first step).

Figure 9:
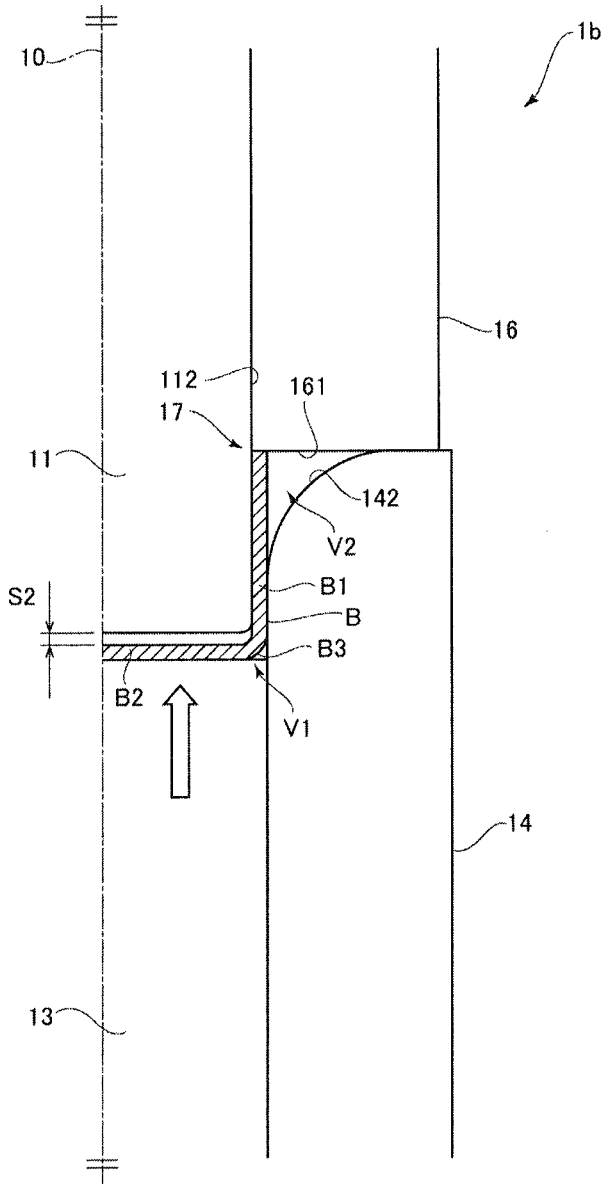
FIG. 9 is a diagram showing an example of the forming situation of the press forming apparatus.

Next, the press forming apparatus 1*b* moves the base 16 downward to a position where the ring-shaped holding down surface 161 becomes contact with an upper end surface 144 of the die 14. Further, as shown in FIG. 9, the press forming apparatus 1*b* moves the forming punch 11 upward and moves a counter punch 13 upward to lift the cup-shaped workpiece B by the counter punch 13, so that the cup vertical wall part B1 is made to abut on the base 16. On this occasion, the press forming apparatus 1*b* moves the forming punch 11 upward to a position where a space S2 of a predetermined size is formed between the forming punch 11 and a cup bottom part B2 (second step).

In other words, in the first step, the press forming apparatus 1*b* moves the forming punch 11 downward, i.e., in a first direction along a center axis 10, and the forming punch 11 is inserted into the die 14, thereby to form the disk-shaped workpiece A into the cup-shaped workpiece B. Thereafter, in the second step, the press forming apparatus 1*b* makes the forming punch 11 recede upward, i.e. in a second direction being opposite to the first direction and moves the counter punch 13 upward, to make the cup vertical wall part B1 abut on the holding down member 16 positioned more above the die 14. Thereby, the press forming apparatus 1*b* makes the cup-shaped workpiece B move to the position where the space S2 is formed between the cup bottom part B2 and the forming punch 11.

From this state, the press forming apparatus 1*b* further moves the counter punch 13 upward to push the cup bottom part B2 to a forming punch 11 side, so that the cup bottom part B2 is compressed by the forming punch 11 and the counter punch 13. Thereby, similarly to in the first embodiment, a material of the cup vertical wall part B1 is made to flow to a cup shoulder part B3, to thicken the cup shoulder part B3 (third step).

It is proved that when the cup bottom part B2 is pushed to the forming punch 11 side from the state of FIG. 9 and the cup bottom part B2 is further pushed to the forming punch 11 side after completion of thickening of the cup shoulder part B3, a weighted load of the counter punch 13 is increased compared with a weighted load at a time of thickening of the cup shoulder part B3. Besides, it is proved that at this time the material of the cup-shaped workpiece B flows to a portion positioned in a void V2 in the cup vertical wall part B1. Here, the void V2 means a space between a corner part 17 formed by an outer peripheral surface 112 of the forming punch 11 and the ring-shaped holding down surface 161 of the base 16, and the shoulder part 142.

In other words, when the counter punch 13 is to be moved upward from a state where the space S2 exists between the cup bottom part B2 and the forming punch 11, first, the material flows to the cup shoulder part B3. It is proved that when the cup bottom part B2 is further pushed to the forming punch 11 side after completion of thickening of the cup shoulder part B3, a portion (portion positioned between the die shoulder part 142 and the forming punch 11 in the cup vertical wall part B1) on a base 16 side where deformation in a plate thickness direction is not restrained in the cup vertical wall part B1 buckles.

Therefore, when the counter punch 13 is to be moved upward from the state where the space S2 exists between the cup bottom part B2 and the forming punch 11, the weighted load of the counter punch 13 is observed, and upper movement of the counter punch 13 is halted when the weighted load reaches a predetermined value. Thereby, it is possible to avoid buckling of the portion on the base 16 side where deformation in the plate thickness direction is not restrained in the cup vertical wall part B1. Further, it is also possible to prescribe completion of thickening of the cup shoulder part B3 by a movement amount of the counter punch 13.

Note that the above-described weighted load (predetermined value) and the movement amount (predetermined value) of the counter punch 13 being threshold values to halt upward movement of the counter punch 13 are determined as follows. First, before forming of the cup-shaped workpiece B, a cup bottom part B2 of a cup-shaped workpiece B of the same standard as that of the above cup-shaped workpiece B is compressed by the counter punch 13 having been moved upward and the forming punch 11, and on this occasion, a weighted load of the counter punch 13 is observed.

Subsequently, in a measurement result of the weighted load of the counter punch 13, there is determined a point at which the weighted load of the counter punch 13 is decreased prominently, that is, a point at which a portion (portion positioned between the die shoulder part 142 and the forming punch 11) on the base 16 side where deformation in the plate thickness direction is not restrained in the cup vertical wall part B1 starts to buckle. Then, the weighted load at this point and a movement amount (movement amount of the counter punch 13 from a position from which the counter punch 13 is started to move upward in a state where a cup opening part side end part B11 is held down by the holding down member to a position of the counter punch 13 at the above point) of the counter punch 13 at this point are determined as respective threshold values to halt upward movement of the counter punch 13.

As a result of the above procedure, also in the present embodiment, it is possible to contrive suppression of thinning of the cup shoulder part B3, suppression of thinning of the cup vertical wall part B1, and planarization of the cup-bottom part B2 simultaneously at the time that the disk-shaped workpiece A is formed into the cup-shaped workpiece B. Further, in the present embodiment, since the base 16 as the holding down member is not required to be inserted between the forming punch 11 and the die 14, forming can be carried out by using the same base 16 regardless of a thickness of a workpiece A being a forming object, so that versatility can be improved.

Modification Example

In the first and second embodiments, top and bottom of a tool may be reversed, that is, the counter punch 13 and the die 14 may be disposed on an upper side, and the forming punch 11, the blank holder punch 12, and the base 16 may be disposed on a lower side.

In the first step in the first embodiment, the press forming apparatus 1*a* may form the disk-shaped workpiece A into the cup-shaped workpiece B by moving the die 14 upward, to move the forming punch 11 relatively in relation to the die 14 and make the forming punch 11 inserted into the insertion hole part 141, so that the disk-shaped workpiece A is thereby pushed into the insertion hole part 141, instead of by the aforementioned configuration.

In the second step in the first embodiment, the press forming apparatus 1*a* may make the cup-shaped workpiece B move to the position where the space S2 is formed between the cup bottom part B2 and the forming punch 11 by moving the forming punch 11 upward after making the blank holder punch 12 abut on the cup opening part side end part B11 of the cup vertical wall part B1 and supporting the cup bottom part B2 with the counter punch 13, instead of by the aforementioned configuration.

In the third step in the first embodiment, the press forming apparatus 1*a* may make the cup bottom part B2 compressed by the forming punch 11 and the counter punch 13 by moving both forming punch 11 and blank holder punch 12 downward while a relative position to each other is maintained in a state where the cup bottom part B2 is supported by the counter punch 13, instead of by the aforementioned configuration.

In the second embodiment, there is a case where the cup vertical wall part B1 is longer than a length of the die shoulder part 142 in the center axis 10 direction. In other words, there is a case where the cup vertical wall part B1 can be held down by the base 16 positioned above the upper end surface 144 of the die 14. In this case, in the third step, the press forming apparatus 1*b* may make the cup bottom part B2 compressed by the forming punch 11 and the counter punch 13 by moving both forming punch 11 and base 16 downward while a relative position to each other is maintained in a state where the cup bottom part B2 is supported by the counter punch 13, instead of by the aforementioned configuration.

Hereinabove, embodiments and examples of the present invention are described in detail, but the embodiments and the examples merely show examples of concretization in implementing the present invention. The technical scope of the present invention is not to be construed in a restrictive manner by these embodiments. That is, the present invention may be implemented in various forms without departing from the technical spirit or main features thereof.

INDUSTRIAL APPLICABILITY

The present invention is a technique effective for a press forming method to form a flat plate-shaped workpiece into a cup shape. Besides, according to the present invention, it is possible to contrive suppression of thinning of a cup shoulder part, suppression of thinning of a cup vertical wall part, and planarization of a cup bottom part simultaneously at a time that the plate-shaped workpiece is formed into a cup shape.

The invention claimed is:

1. A press forming method carrying out press forming to a flat plate-shaped workpiece by using a press forming die which has a forming punch, a holding down member disposed along an outer periphery of the forming punch, a counter punch disposed to face the forming punch in a center axis direction, and a die in whose insertion hole part the counter punch is disposed and one end side inner wall surface of whose insertion hole part into which the forming punch is inserted is a die shoulder part, center axes thereof being coaxially disposed to one another, the press forming method sequentially comprising:

a first step of pushing the flat plate-shaped workpiece into the insertion hole part via the die shoulder part by making the forming punch move relatively in relation to the die and be inserted into the insertion hole part, thereby to form the workpiece into a cup-shaped workpiece having a cup vertical wall part, a cup bottom part, and a cup shoulder part connecting the cup vertical wall part and the cup bottom part;

a second step of making the cup-shaped workpiece move relatively in relation to the forming punch, to a position where a space is formed between the cup bottom part and the forming punch by the holding down member abutting on a cup opening part side end part of the cup vertical wall part; and a third step of restraining deformation in a plate thickness direction of the cup vertical wall part by the forming punch and the die and making the counter punch approach the forming punch in a state where a relative position in relation to the forming punch of the cup vertical wall part is fixed by the holding down member, to push the cup bottom part to a forming punch side, to make the cup bottom part compressed by the forming punch and the counter punch, and to make a material of the cup vertical wall part flow to the cup shoulder part, thereby to thicken the cup shoulder part.

2. The press forming method according to claim 1, wherein the holding down member is a cylindrical blank holder punch whose inner peripheral surface in a radial direction orthogonal to the center axis runs along an outer peripheral surface of the forming punch and whose outer peripheral surface in the radial direction runs along an inner peripheral surface of the insertion hole part of the die, and wherein in the third step the cup bottom part is compressed by the forming punch and the counter punch in a state where a relative position in relation to the forming punch of the cup vertical wall part is fixed by the holding down member inserted between the forming punch and the die and deformation in the plate thickness direction on a cup opening part side in the cup vertical wall part is restrained by the forming punch and the die.

3. The press forming method according to claim 1, wherein in the first step the forming punch is moved in a first direction along the center axis and the forming punch is inserted into the die, to form the workpiece into the cup-shaped workpiece, and wherein in the second step the forming punch is made to recede in a second direction opposite to the first direction and the counter punch is moved in the second direction to make the cup vertical wall part abut on the holding down member placed further in the second direction than the die, to make the cup-shaped workpiece move relatively to a position where the space is formed between the cup bottom part and the forming punch.

4. The press forming method according to claim 3, wherein an outer diameter of the holding down member is larger than an outer diameter of the die shoulder part.

5. The press forming method according to claim 3, wherein in the third step the counter punch is moved in the second direction from a state where a portion in which deformation in the plate thickness direction is not restrained exists, the portion being a portion positioned between the die shoulder part and the forming punch in the cup vertical wall part, and from a state where the space exists between the cup bottom part and the forming punch, and a weighted load of the counter punch is monitored, and wherein, when the weighted load reaches a predetermined value, movement of the counter punch in the second direction is halted, thereby to suppress flowing of a material to the portion positioned between the die shoulder part and the forming punch in the cup vertical wall part.

* * * * *